US011958790B2

(12) United States Patent
Van Driel et al.

(10) Patent No.: US 11,958,790 B2
(45) Date of Patent: Apr. 16, 2024

(54) CO-LAYERED PROPELLANT CHARGE

(71) Applicant: Nederlandse Organisatie voor toegepast-natuurwetenschappelijk onderzoek TNO, 's-Gravenhage (NL)

(72) Inventors: Christoffel Adrianus Van Driel, Delft (NL); Martijn Zebregs, The Hague (NL); Dinesh Ravindre Ramlal, The Hague (NL); Michiel Hannes Straathof, Delft (NL)

(73) Assignee: Nederlandse Organisatie voor toegepast-natuurwetenschappelijk onderzoek TNO, 's-Gravenhage (NL)

( * ) Notice: Subject to any disclaimer, the term of this patent is extended or adjusted under 35 U.S.C. 154(b) by 1095 days.

(21) Appl. No.: 16/639,621

(22) PCT Filed: Aug. 20, 2018

(86) PCT No.: PCT/NL2018/050546

§ 371 (c)(1),
(2) Date: Feb. 17, 2020

(87) PCT Pub. No.: WO2019/035716

PCT Pub. Date: Feb. 21, 2019

(65) Prior Publication Data

US 2020/0239380 A1 Jul. 30, 2020

(30) Foreign Application Priority Data

Aug. 18, 2017 (EP) ..... 17075021

(51) Int. Cl.

| | |
|---|---|
| ***C06B 45/12*** | (2006.01) |
| ***C06B 21/00*** | (2006.01) |
| ***C06B 45/02*** | (2006.01) |

(52) U.S. Cl.
CPC ..... *C06B 45/12* (2013.01); *C06B 21/0083* (2013.01); *C06B 45/02* (2013.01)

(58) Field of Classification Search
None
See application file for complete search history.

(56) References Cited

U.S. PATENT DOCUMENTS

| | | | | |
|---|---|---|---|---|
| 1,077,320 | A | 11/1913 | Walsh | |
| 3,002,459 | A | 10/1961 | Harper | |
| 3,166,612 | A * | 1/1965 | Sauer | C06B 21/0075 264/203 |
| 4,581,998 | A | 4/1986 | Horst, Jr. et al. | |
| 2009/0208647 | A1 | 8/2009 | Ryf et al. | |
| 2015/0284301 | A1 * | 10/2015 | Durand | B29C 48/09 264/3.3 |

* cited by examiner

*Primary Examiner* — Aileen B Felton
(74) *Attorney, Agent, or Firm* — Banner & Witcoff, Ltd.

(57) ABSTRACT

The invention is directed to a co-layered propellant grain having an exposed outer surface, wherein said propellant grain comprises an outer layer comprising a slow burning propellant composition located on essentially the entire outer surface of the grain, and an inner layer comprising a fast burning propellant composition having a higher linear burn rate than said slow burning propellant composition; wherein said propellant grain has a structure such that after ignition, the inner layer becomes increasingly exposed at the outer surface.

21 Claims, 8 Drawing Sheets

CO-LAYERED PROPELLANT CHARGE

RELATED APPLICATIONS

This application is a National Stage Application under 35 U.S.C. 371 of co-pending PCT application PCT/NL2018/050546 designating the United States and filed Aug. 20, 2018; which claims the benefit of EP application number 17075021.0 and filed Aug. 18, 2017 each of which are hereby incorporated by reference in their entireties.

FIELD OF THE INVENTION

The invention is in the field of propellant charge for launching projectiles from guns and the like. The invention is particularly directed to a co-layered propellant charge.

BACKGROUND OF THE INVENTION

Propellant charges are known to greatly influence the ballistics such as the velocity of projectiles that are launched from guns and the like. The ballistics can be influenced by the linear burn rate, which is determined by the chemical composition, and the shape or geometry of the grains that are comprised in the propellant charge. The linear burn rate (r) is the rate with which the burning surface normal to the surface regresses and is dependent on the pressure (P), the pressure exponent ($\alpha$) and the pre-exponential factor ($\beta$) in the law of Vieille (equation 1):

$$r=\beta\times P^{\alpha} \quad \text{(equation 1)}$$

The pressure exponent $\alpha$ is i.a. determined by the chemical composition of the propellant. The pressure exponent $\alpha$ of nitrocellulose-based propellant is for instance typically in the range of 0.6 to 0.8, for double-based propellant in the range of 0.8 to 1.0 and for some low vulnerability (LOVA) propellants typically in the range of 1.0 to 1.3.

The burn rate in terms of produced gas per time, also referred to as dynamic vivacity, or liveliness (L), can be influenced by a combination of the linear burn rate and the geometry of the grains. The dynamic vivacity can be calculated from the pressure increase in a closed vessel and is dependent on the pressure in the closed vessel in accordance with equation 2, wherein $P_{max}$ is the maximum pressure observed.

$$L=\frac{dP}{dt}(P\times P_{max})^{-1} \quad \text{(equation 2)}$$

When plotting the dynamic vivacity versus the relative pressure ($P/P_{max}$), the trend of the resulting curve is illustrative of the progress of dynamic vivacity during the burning. A progressive burning progress means that, typically after an initial increase and decrease of the dynamic vivacity in time, the dynamic vivacity increases during the burning, a neutral burning progress means that the dynamic vivacity remains essentially constant during the burning, while a degressive burning progress means that the dynamic vivacity decreases during the burning. The burning progress is herein also referred to as burning profile. In FIG. 1, examples of progressive, neutral and degressive burning profiles are illustrated.

Propellant grains for large caliber applications usually comprise a single type of propellant composition. In that case the progressivity of the burning process is dependent on the geometry of the propellant grain. The geometry determines the development of the surface at which the grain can burn. For instance, the surface of a solid grain in the shape of a cylinder or sphere decreases during burning, such that the surface at which the grain can burn decreases and the burning generally progresses degressively. In case a grain has a cylindrical shape with one perforation in the length direction of the grain, the inner surface (i.e. the surface formed due to the perforation) increases at the same rate as the outer surface decreases (i.e. the remaining surface). The surface area of grains in the shape of a flake or plate also remains essentially the same during burning. As such, such grains generally burn neutrally (i.e. the burning process is neutral). Grains that are cylindrical and have multiple perforations in the length direction, for instance 7 or 19 perforations, the total inner surface (i.e. the surface formed by all perforations) increases faster than the outer surface decreases. As such, the overall surface increases and the burning progresses progressively.

After the projectile is initially launched by the initial pressure build up, the volume in which the remaining propellant will burn has increased, and will further increase in time. To compensate for this increasing volume, it is generally preferred to have a progressive burning profile. Accordingly, conventional propellant grains are generally perforated with for instance up to 19 perforations.

A drawback of the conventional grains, especially those for large caliber applications, that have for instance 19 perforations, is that the flame temperature is about the same throughout the whole conversion. The temperature of the initially produced gases is generally high such that it results in significant barrel erosion. Conventional high-performance propellants like those for tank applications have a high flame temperature. The widely used JA2 propellant composition, for example, has a flame temperature of 3400 K. The flame temperature of other propellants are as high as 5000 K or even higher. Such high flame temperatures cause serious erosion of the gun barrel, resulting in a limited life time of the barrel, which is reported to be proportional to $(T_f)^{4.7}$, according to B. Lawton, 'Thermo-chemical erosion in gun barrels', Wear 251 (2001) 827-838, or even more. In case of a tube propellant the diameter of the perforation is typically 2 mm and such large perforations result in less propellant composition in the space that is available for the propellant charge. This results in a decrease of the overall amount of gas that can be produced. Moreover, tube propellant burns neutrally.

The surface of propellant grains with smaller dimensions, e.g. those used in medium and small caliber applications, are generally impregnated with a substance which is less energetic than the composition of the core of the grain. For this purpose non-energetic plasticizers or non-energetic polymers can be used. Such impregnations result in both an initial linear burn rate that is lower than the burn rate of the propellant core and an initial flame temperature that is lower than the flame temperature of the core. Consequently, the progressivity of such impregnated propellant grains is improved in relation to non-impregnated propellant grains, and such impregnated propellant grains cause less gun barrel erosion than non-impregnated propellant grains. Impregnation of propellant grains for large caliber applications, having relatively large websizes, is generally not effective because the impregnation depth is limited.

As an alternative to perforations or to further optimize the progressivity of the grains, co-layered propellants have been proposed. Co-layered propellants comprise two or more layers of different propellant compositions.

In U.S. Pat. No. 4,581,998, a plate-shaped propellant is disclosed having an inner layer of a faster burning composition that is sandwiched between two outer layers that each have a slower burning composition. After the outer layers have been consumed, the inner layer is exposed and the dynamic vivacity increases because the faster burning composition has a higher linear burn rate than the slower burning composition.

WO2015/021545 discloses cylinder-shaped co-layered propellants and a method for producing these propellants. The described cylinder-shaped co-layered propellants comprise three layers and are structured such that the first burning (i.e. outer) layers comprise a slower burning composition and that after the first burning layers have been consumed, a second burning layer comprising a faster burning composition will be exposed. A drawback of these co-layered propellants described in U.S. Pat. No. 4,581,998 and WO2015/021545, is that the faster burning composition is exposed at once, which limits the control over the burning profile. In addition, the thickness of the outer layer must be extremely well defined in order to have the outer layer be fully consumed at the moment when the pressure in the weapon is just decreasing after reaching its first maximum level. In case the thickness of the outer layer is just a little too small or too large, the pressure in the weapon may become far too large causing weapon failure, or, respectively, the effect of the faster burn rate of the core composition will be nullified. Accordingly, to the best of the knowledge of the present inventors, the co-layered propellants described in the art have commercially not been applied successfully.

In U.S. Pat. No. 3,166,612, propellants having two or more discrete layers are disclosed, which geometry is chosen such that a progressive burning can be obtained. It is described that progressivity is solely achieved by burning through consecutive layers of the propellant grains. The present inventors found that a drawback of this approach is that only a limited control over the progressivity can be obtained, i.a. due to formation of slivers that limit progressive burning.

It is desired to provide a propellant grain that does not suffer from one or more of the above-described drawbacks.

SUMMARY OF THE INVENTION

The present inventors surprisingly found that this can be achieved by a propellant comprising a fast burning composition and having a structure such that after ignition, the fast burning composition is gradually increasingly exposed, while sliver formation is minimized.

BRIEF DESCRIPTION OF THE DRAWINGS

In FIG. 13, the change of the cross-sectional shape of the grain after ignition is illustrated as well as.

DETAILED DESCRIPTION OF THE INVENTION

Figure 1:
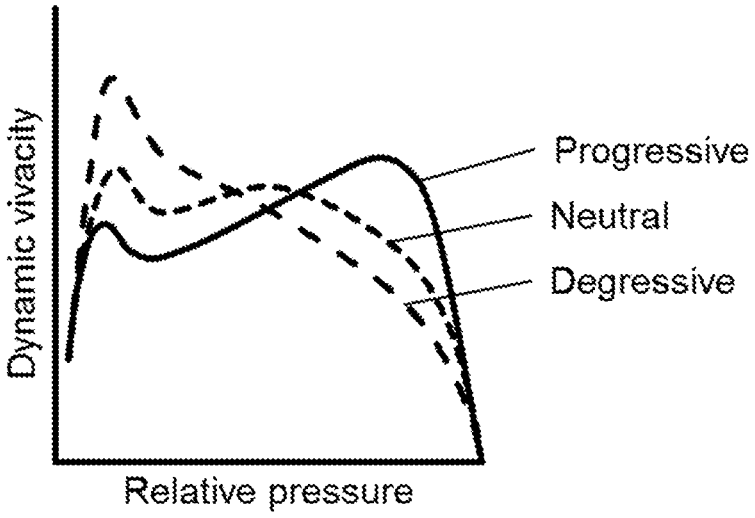
FIG. 1 illustrates examples of progressive, neutral and degressive burning profiles.

The present invention is particularly directed to a co-layered propellant grain having an exposed outer surface, wherein said propellant grain comprises an outer layer comprising a slow burning propellant composition located on essentially the entire outer surface of the grain, and an inner layer comprising a fast burning propellant composition having a higher linear burn rate than said slow burning propellant composition; wherein said propellant grain has a structure such that after ignition, the inner layer becomes increasingly exposed at the outer surface. In the present invention, the grain is preferably perforated meaning that the grain preferably further comprises an exposed inner surface having an area that increases after ignition. The shape of the inner surface may vary, as the cross-sectional shape of the perforation may for instance be spherical, but also non-spherical such as helical, square, triangular and the like.

Before ignition, the exposed outer surface of the present grain is thus essentially entirely formed by said outer layer. After ignition, the outer layer gradually burns away thereby gradually exposing the inner layer. The propellant grain of the present invention can thus also be described as having a structure such that an exposed outer surface of the grain is essentially entirely formed by said outer layer and which outer surface, after ignition, becomes increasingly formed of the inner layer as well.

The area of the exposed outer surface of the grain generally decreases during the burning, and as long as this outer surface is formed by the slow burning propellant composition the burning profile of the outer surface is initially relatively degressive. This means that during the initial burning progress, less and less gas is produced at the outer surface compared to the amount of gas that was produced at the outer surface just after ignition. However, as soon as the outer surface becomes increasingly formed by the fast burning composition, more gas can be produced relative to the amount of gas that was produced at the outer surface just after ignition. Thus, the grain of the present invention has a structure such that an outer surface of the grain is essentially entirely formed by an outer layer comprising an outer propellant composition that has a lower linear burn rate and which outer surface, after ignition, becomes increasingly additionally formed of the inner layer.

The inner layer comprises the fast burning propellant composition, while the outer layer comprises the slow burning propellant composition. This means that the propellant composition comprised in the inner layer has a higher linear burn rate than said slow burning propellant composition.

Propellant compositions with different linear burn rates are known in the art (see for instance US2015/284301). A typical slow burning propellant composition of the present invention may for instance comprise single base (SB) propellant that consists of 90 wt % or more of nitrocellulose (NC) with a nitrogen content of less than 12.5 wt %. NC with a higher nitrogen content can burn faster. In addition, the porosity of the grains can also influence the burn rate of the propellant composition, as is described for instance in Eisenreich et al. Propellants, Explosives, Pyrotechnics 27 (2002) 142-149.

In addition, the linear burn rate can be influenced by impregnation of the layer and/or grain with non-energetic plasticizers or non-energetic polymers (see for instance US2009/0208647 on the impregnation of propellant grains).

Propellant compositions that burn faster (i.e. have a higher linear burn rate) than SB include for instance double base (DB) propellant, which consist of NC with about 10 to 50 wt % nitroglycerine (NG), and triple base (TB) propellant, which is known to comprise NC, NG and nitroguanidine (NQ). DB typically has a higher linear burn rate than TB. Quadrupel (QB) and multi-base (MB) propellants as well as low vulnerability (LOVA) propellants are also known.

The linear burn rate of the propellant compositions can also be influenced by the presence of additional non-energetic or energetic plasticizers such as dinitrotoluene (DNT), alkyl nitratoethyl nitramines (alkyl NENAs), bis (2-nitroxyethyl) nitramine (DINA), octahydro-1,3,5,7-tetranitro-1,3,5,7-tetrazocine (HMX), 2,4,6,8,10,12-hexanitro-2,4,6,8,10,12-hexaazatetracyclo[5.5.0.03,11.05,9]dodecane (CL-20), 1,1-diamino-2,2-dinitroethene (DADNE or FOX-7), ammonium dinitramide (AND), ammonium nitrate (AN) and the like.

The layers and propellant compositions of the present invention may also comprise composite propellants that comprise a polymer matrix. The polymer matrix may comprise a mixture of non-energetic and energetic plasticizers.

Figure 2:
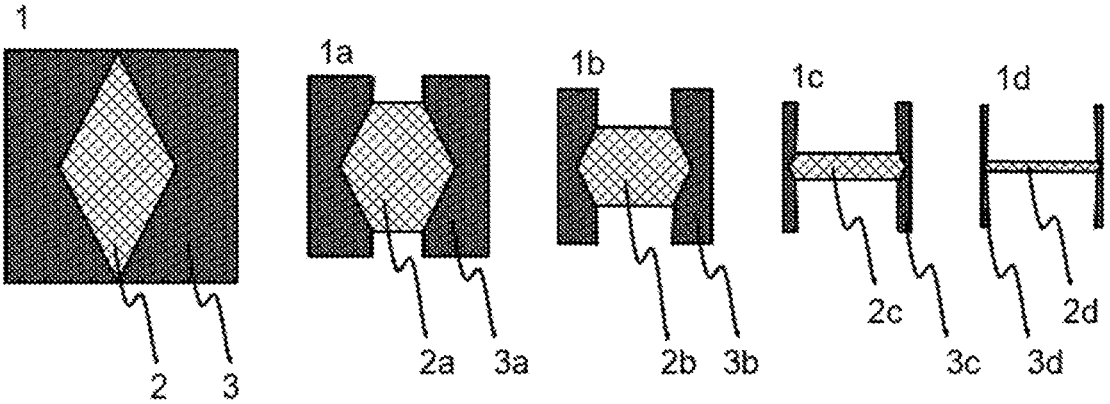
In FIG. 2, a cross-section of a comparative propellant grain that is not in accordance with the present invention is illustrated.
Figure 4:
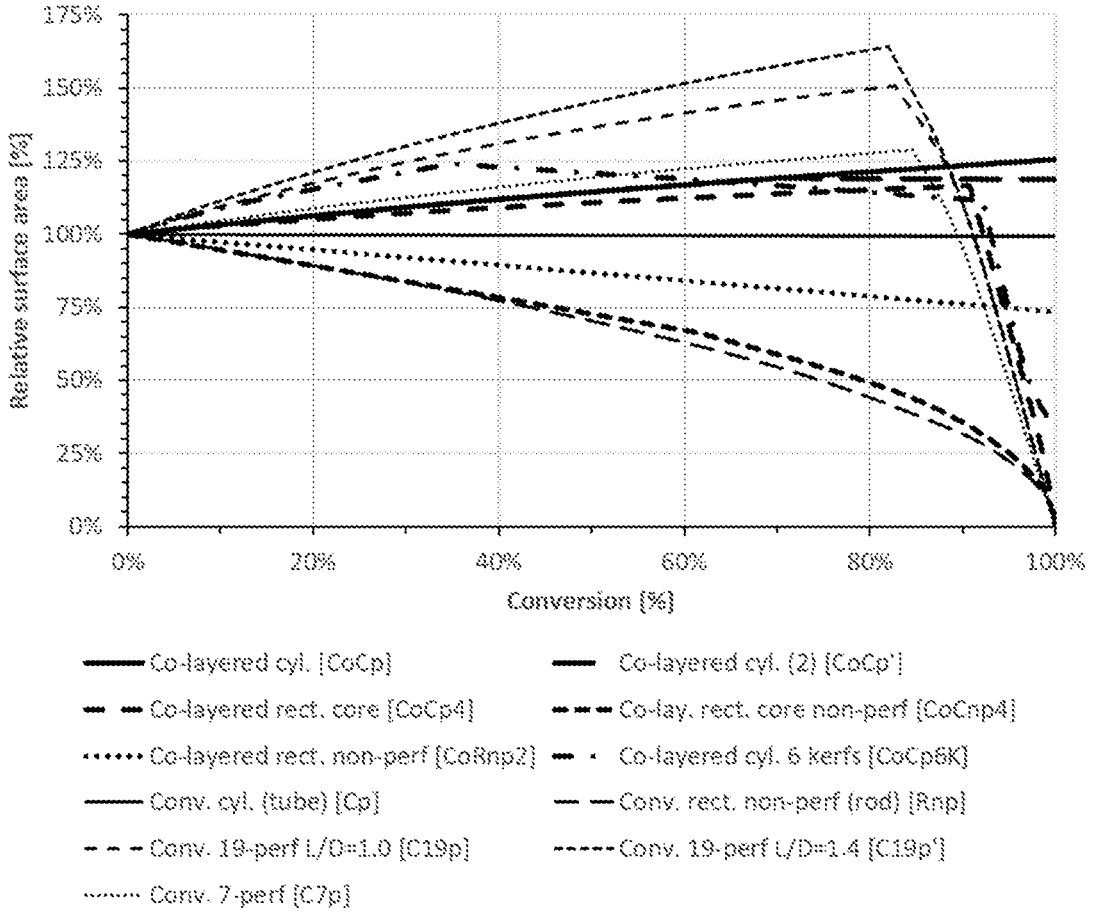
FIG. 4 shows the relative surface area of grains having various shapes plotted against the conversion of the overall propellant composition. The conversions in time are plotted for the following grain shapes: a co-layered cylindrical tube having a single perforation (CoCp'), a co-layered cylindrical tube having a core with a square cross-sectional shape as illustrated in FIG. 9 (CoCp4) in accordance with the present invention, a co-layered cylindrical tube having six kerfs as illustrated in FIG. 16 (CoCp6K), a co-layered cylinder having a solid core with a square cross-sectional shape (CoCnp4) as reference, a single-layered cylindrical tube (Cp) as reference, a single-layered cylindrical shape having 19 co-axial perforations and an L/D-ratio of 1.0 (C19p) as reference, a single-layered cylindrical grain having 7 co-axial perforations and an L/D-ratio of 2.0 (C7p) as reference, another co-layered cylindrical tube grain having a thicker outer layer as CoCp' (CoCp) as reference, a co-layered rectangular non-perforated rod-like grain having a cross-sectional shape as illustrated in FIG. 2 (CoRnp2) as reference, a single-layered rectangular non-perforated rod (Rnp2) as reference and a single-layered cylindrical shape having 19 co-axial perforations and an L/D-ratio of 1.4 (C19p') as reference.

A particular advantage of the present invention is that the burning profile of a propellant grain having a certain shape can be improved, i.e. can be made more progressive, without requiring to change the shape of the propellant grain, while the negative effect of sliver formation is limited, postponed or prevented by the perforation. For instance, a rod-shaped non-perforated propellant grain comprising a single propellant composition has a degressive burning profile (cf. FIG. 5, Rnp). By providing the rod-shaped non-perforated propellant grain (1), having a cross-section as illustrated in FIG. 2, with the inner layer (2) that is surrounded by the outer layer (3) in accordance with the present invention, a neutral burning profile (i.e. a neutral progressivity with regard to the dynamic vivacity) can be obtained. During consumption of the grain, the shape of the grain (1*a* to 1*d*) changes, thereby increasingly exposing the fast burning propellant composition (2*a* to 2*d*). The total amount of exposed surface area of the inner layer increases, thereby, such that the decrease of surface area of the outer layer is compensated and an overall neutral burning profile can be obtained (cf. FIG. 5, CoRnp2) even though the overall surface area of the grain decreases during conversion (cf. FIG. 4, CoRnp2). This principle particularly applies when the ratio of the linear burn rate of the fast burning propellant composition to the linear burn rate of the slow burning propellant composition is about 2. In case this ratio is larger, a progressive burning profile may be obtained.

Figure 3:
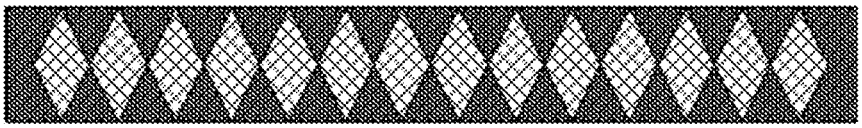
FIG. 3 shows a cross-section of a comparative plate propellant grain that is not in accordance with the present invention.

A plate-shaped propellant grain in accordance with the present invention, as illustrated in FIG. 3, can also have a progressive burning profile, in contrast to single-layered plate-shaped propellant grains that typically have a neutral burning profile.

Thus, degressive and neutral burning profiles can be improved to obtain more progressive burning profiles, i.e., respectively a neutral and progressive burning profile.

In addition, without wishing to be bound by theory, the present inventors found that sliver formation for co-layered grains without a perforation (i.e. without the exposed inner surface), of which certain embodiments are disclosed in U.S. Pat. No. 3,166,612, typically occurs if the ratio between the burn rates between the faster burning inner layer and the slower burning outer layer is relatively large. In such case, parts of the grain can become separated from each other (i.e. slivering occurs) causing a further degressive burning profile. Moreover, the inventors found that, although up to the moment of slivering the progressivity of the burning may be increased, this advantage can be cancelled by the degressive burning after slivers are formed. The inventors also found that sliver formation for said co-layered grains without a perforation generally occurs at a relatively low conversion. For instance, for a grain shape as illustrated in FIG. 3*c* of U.S. Pat. No. 3,166,612 (i.e. a CoCnp4-shaped grain), the inventors found that in case of a burn rate ratio of about 1.4, slivering occurs at about 62% (cf. the change of the derivative of the curve in FIG. 5 for CoCnp4), when assuming that the burning progresses strictly perpendicular to all of the surfaces, thus also near the vertices of the inner layer. Assuming that the surfaces close to the vertices form curved surfaces during the burning, degressive burning will occur at an even earlier conversion, e.g. about 40% for a burn rate ratio of about 1.4. In contrast, by providing an exposed inner surface as preferred for the present invention, sliver formation occurs at a much higher conversion, e.g. at about 91%

(cf. CoCp4 in FIG. 5 under the assumption that the burning progresses strictly perpendicular to all of the surfaces), thereby both improving and prolonging the progressive burning profile of the grain.

For the present invention, it is preferred that the ratio of the linear burn rate of the fast burning propellant composition to the linear burn rate of the slow burning propellant composition is more than 1.5, preferably more than 1.7, more preferably more than 2.

For the present invention, the outer layer comprising the slow burning propellant composition is located on essentially the entire outer surface of the grain. Thus, the outer surface of the grain is essentially entirely formed by an outer layer comprising an outer propellant composition. This means that at least 80%, preferably at least 90%, more preferably at least 95%, even more preferably at least 99%, most preferably 100% of the outer surface is formed by the outer layer. Thus, the slow burning propellant composition is located on at least 80%, preferably at least 90%, more preferably at least 95%, even more preferably at least 99%, most preferably at least 100% of the entire outer surface of the grain. In preferred embodiments, the outer surface of the grain is entirely formed by an outer layer, but this may not be required to obtain the advantages of the present invention.

For certain grain shapes such as rods, cylinders, plates and the like, having an elongated shape, the grains of the present invention can be obtained by an extrusion process (vide infra), which generally results in two or more terminal surfaces, in addition to the outer surface of the grain. In case of an elongated shape having terminal surfaces as obtainable by an extrusion process, the outer surface can be regarded as the surface in the elongated direction, while the terminal surface can be regarded as the surface that formed by at termini of the shape, generally about perpendicular to the outer surface. The terminal surface may be partially formed of the inner layer, due to the nature of the extrusion process. These terminal surfaces are generally small in comparison to the outer surface and can therefore be typically neglected for the burning profile of the propellant grains. For grains having an elongated shape (also referred to as a longitudinally extending shape), an L/D ratio may be defined. The L/D ratio is defined as the ratio of the maximum dimension of the grain in the length direction divided by the maximal dimension of the grain perpendicular to the length direction of the grain. A higher LID ratio, results in less influence of the terminal surfaces on the burning profile of the grain. Accordingly, for elongated shapes the L/D ratio is preferably more than 2, preferably more than 5, most preferably more than 10.

In a preferred embodiment, the propellant grain according to the present invention has a longitudinally extending shape, and preferably one or more perforations passing through the grain in the length direction that provide an exposed inner surface of the grain.

The inner surface of the grain is defined as a surface having an area that increases after ignition. The inner surface of the grain may be formed of the inner layer, of the outer layer, or of both the inner layer and the outer layer. The inner surface may also be formed by an additional layer, which additional layer may comprise the fast burning propellant composition, the slow burning composition or a third propellant composition having yet another linear burn rate. In a preferred embodiment, the inner surface is at least partially formed by the inner layer—i.e. said inner layer is located on at least part of the inner surface. It was found that this generally results in a grain having progressive burning profile. In a particularly preferred embodiment, the inner surface is entirely formed by the inner layer—i.e. said inner layer is located on essentially the entire inner surface.

Figure 9:
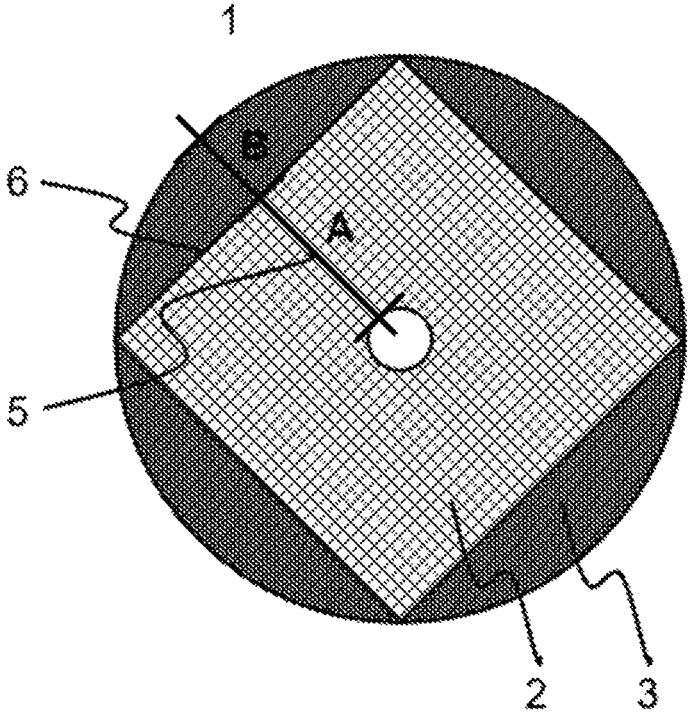
FIGS. 9 and 10 illustrate cross-sections of particular embodiments of the present invention, that may be favorable in terms of sliver formation.

The perforation of the grain to provide exposed inner surface having an area that increases after ignition, limits the early formation of degressively burning parts. This advantageously prolongs the progressive burning profile of the grain. Sliver formation is explained herein in more detail below and can be observed in the burning profile curves illustrated in FIGS. 4 and 5. Although, the comparative co-layered cylinder having a solid core with a square cross-sectional shape (CoCnp4) indeed has a more progressive burning profile as the conventional rectangular non-perforated rod (RnP), (the progressivity of the CoCnp4 is higher), the present inventors realized, as explained herein-above, that the burning profile of the CoCnp4 grain becomes degressive after a relatively early formation of slivers and/or if the outer layer is consumed before slivers are formed. Therefore, degressive burning due to slivers formation and/or other geometrical changes preferably occurs as late as possible during the conversion. This problem can be solved by providing the grain with an exposed inner surface, as can be illustrated by comparing CoCnp4 with the co-layered cylindrical tube having a core with a square cross-sectional shape as illustrated in FIG. 9 (CoCp4) in accordance with the present invention. The CoCp4 grain shows sliver formation only after about 91% conversion. In addition, the present inventors found that the relative dynamic vivacity of the CoCp4 grain progresses much more steeply than the comparative CoCnp4 (which remains negative).

Preferred shapes for the grains are those shapes of which the cross-section is circular, or nearly circular, or of which the cross-section is a polygon, preferably a regular polygon. In the embodiments wherein said cross-sectional shape of the grains is a polygon, said polygon has a number of vertices that is equal or double to the number of vertices of the cross section of the inner layer.

Figure 8:
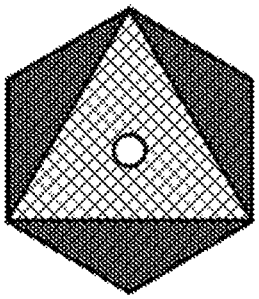
FIG. 8 illustrates yet another embodiment in accordance with the present invention.

A particular embodiment wherein the cross-sectional shape of the grain is a regular polygon is illustrated in FIG. 8.

Preferably the grain is cylindrical or prism shaped. The grains having a cylindrical shape have the circular or nearly circular cross-sectional shape as described above, while the grains having a prism shape have a polygon, preferably a regular polygon, cross-sectional shape as described above. A particular advantage of the cylindrically-shaped or prism-shaped propellant grains is that such grains can be produced with high accuracy and reliability. In this respect, the cylindrically-shaped grain is particularly preferred. In contrast, a drawback of plate-shaped propellant is that the production of these propellants is challenging due to bad adhesion of the layers or possible cracking of the outer layers and concomitant early exposure of the inner layer.

In preferred embodiments of the present invention, the propellant grain according to any of the previous claims, wherein said inner layer has a cross-sectional shape that has one or more vertices directed towards the outer surface of the grain, preferably one or more vertices essentially located at the outer surface of the grain.

Figure 6:
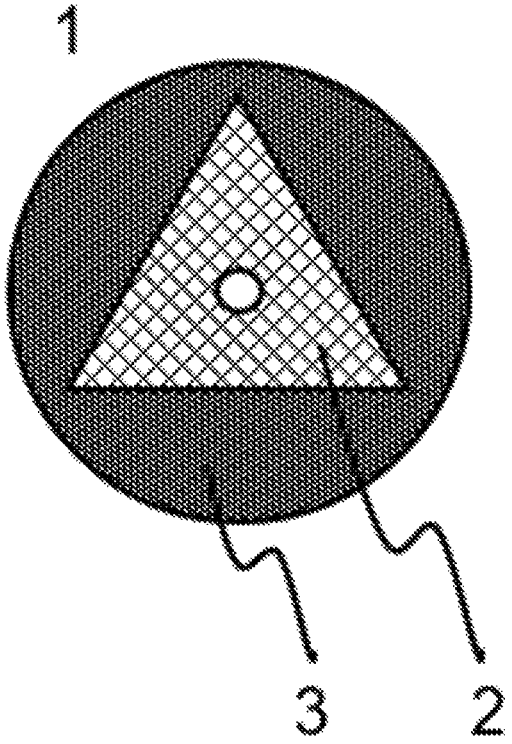
FIG. 6 illustrates a cross-section of a particular embodiment of the present invention.

FIG. 6 illustrates a cross-section of a particular embodiment of the present invention. The grain (1) comprises a cylinder-shape having a concentric perforation in the longitudinal direction. The outer layer (3) concentrically surrounds the inner layer (2), which inner layer (2) has a cross-sectional triangular shape. Thus, the inner layer (2) has a cross-sectional shape that has one or more vertices directed towards the outer surface of the grain. This results in a structure of which, after ignition, the inner layer becomes increasingly exposed at the outer surface.

Figure 7:
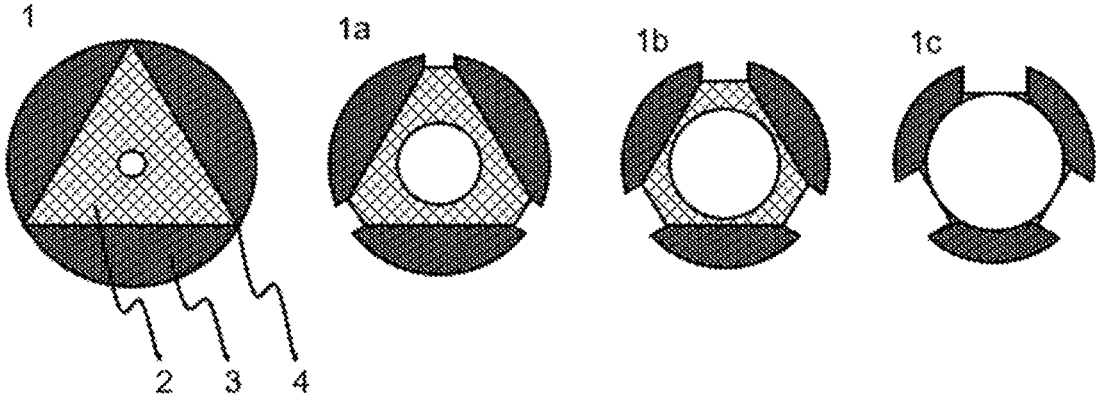
FIG. 7 illustrates a similar embodiment as FIG. 6, with the difference that some of the vertices of the cross-sectional shape of the inner layer are located at the outer surface (4) of the grain, in accordance with the present invention, as well as the change of the cross-sectional shape of the grain, after ignition.

FIG. 7 illustrates a similar embodiment as FIG. 6, with the difference that some of the vertices of the cross-sectional shape of the inner layer are located at the outer surface (4) of the grain. The grain (1) burns such that the inner layer of the grain (1*a*-1*c*) becomes increasingly exposed at the outer surface.

It is preferred that the grains burn essentially symmetrical meaning that similarly shaped slivers are obtained. Accordingly, it is preferred that the said inner layer has a cross-sectional shape that is a polygon, preferably a regular polygon.

The progressivity of the burning profile is typically lost upon formation of the slivers. It is therefore preferable to have a grain wherein slivers are formed at late as possible during consumption of the grain and that the slivers are as small as possible when they are formed. Preferably, the grain of the invention has a structure such that after ignition slivers are only produced after a conversion of 80% or more, preferably 90% or more of the grain. The formation of slivers can be calculated theoretically by assuming that the burning progresses strictly perpendicular to all of the surfaces, thus also near the vertices of the inner layer.

Figure 5:
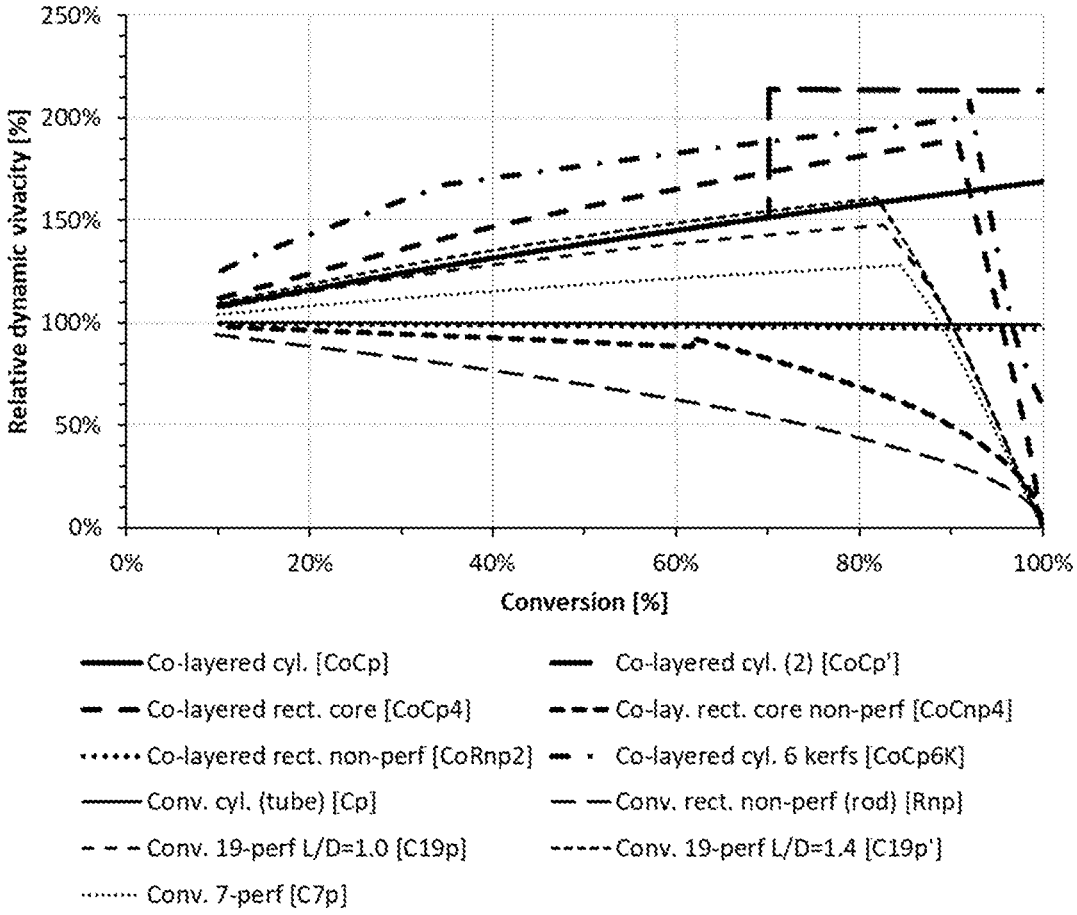
In FIG. 5 the relative dynamic vivacity of grains having various shapes as described for FIG. 4 is plotted against the conversion of the overall propellant composition.
Figure 11:
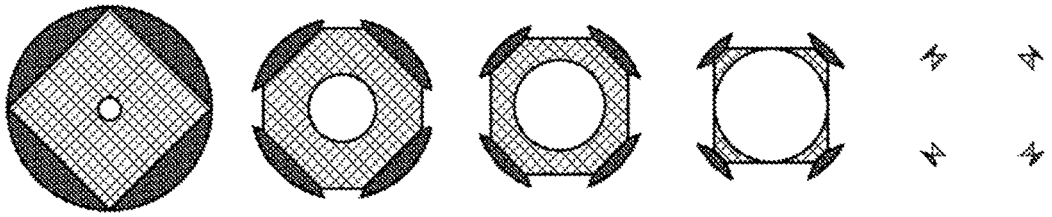
FIG. 11 illustrates the change of the cross-sectional shape of the grain of FIG. 9, after ignition, in accordance with the present invention.

The point of sliver formation can be deduced from the dynamic vivacity curve, i.e. the conversion at which a strong decrease in dynamic vivacity is observed. For instance, as illustrated in FIG. 5, CoCp4, sliver formation for the grain having a cylindrical shape and a cross-section as illustrated in FIGS. 9 and 11, sliver formation is observed at a conversion of about 92%.

It is further preferred that after ignition, slivers are produced that comprise both the fast- and the slow burning compositions during the entire remaining burning process. Such slivers are relatively small upon their creation.

The present inventors found that the sliver formation correlates to when and how the inner layer is exposed and how the remaining burning of the grain progresses. It was further found that the moment of exposure of the inner layer on the outer surface depends i.a. on the ratio of the linear burn rate of the fast-propellant composition to the linear burn rate of the slow burning propellant composition.

Accordingly, in a particularly preferred embodiment of the present invention, the propellant grain has a cylindrical or prism shape and a concentric perforation passing through the grain in the length direction that provides the inner surface. In this embodiment, the outer surface of the grain is formed by the outer layer, and the inner surface of the grain is formed by the inner layer. In addition, the inner layer of the grain has a symmetrical cross-sectional shape having one or more vertices directed to the outer surface of the grain. The cross-sectional shape is preferably rotational symmetric in an order equal to the amount of vertices of the cross-sectional shape, more preferably the cross-sectional shape is a regular polygon. For this embodiment, a geometrical line can be defined as the line that extent from the center of the grain to the outer surface of the grain, while being orthogonal on the contact surface—which is defined as the surface at which the outer and the inner layers meet. Based on the geometrical line, an A/B ratio can be defined wherein A is defined as the part of a geometrical line that passes the inner layer and B is defined as the part of said geometrical line that passes the outer layer. It was found that the A/B ratio is about equal to the ratio of the linear burn rate of the fast burning propellant composition to the linear burn rate of the slow burning propellant composition, is favorable for the sliver formation. With about equal is meant herein equal with a ±10% deviation.

Figure 10:
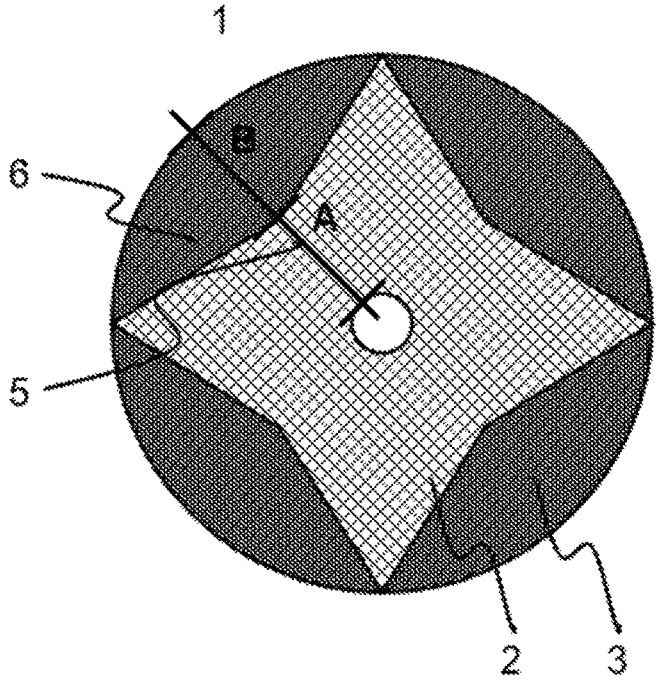

FIG. 9 illustrates the cross-section of a particular embodiment of the present invention that is favorable in terms of sliver formation. The grain (1) comprises the inner layer (2) and the outer layer (3). A geometrical line (5) can be imagined that extents from the center of the cross-section to the outer surface of the grain, while being orthogonal on the contact surface (6) of the inner and outer layers. In FIG. 9, the NB ratio is 2. It may be appreciated that the geometrical line crossing a vertex of the cross-sectional shape inner surface that is located on the contact surface, is considered to be orthogonal on said contact surface, as is illustrated in FIG. 10. It may be appreciated that the A/B ratio can be chosen in accordance with the ratio of the linear burn rate of the fast-propellant composition to the linear burn rate of the slow burning propellant composition. Thus, in embodiments wherein the ratio of the linear burn rate of the fast-propellant composition to the linear burn rate of the slow burning propellant composition is 1.5, the A/B ratio can appropriately be 1.5.

FIG. 11 illustrates the change of the cross-sectional shape of the grain of FIG. 9, after ignition.

Figure 12:
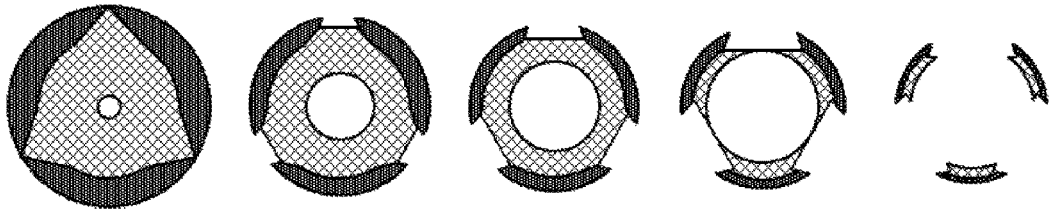
FIG. 12 illustrates a cross-section of yet another embodiment of the present invention, as well as the change of the cross-sectional shape of the grain, after ignition.

The A/B ratio can be adjusted by providing the appropriate cross-sectional phase of the inner layer. For instance, the grain as illustrated in FIG. 7, does not have an A/B ratio of 2 due to the triangularly shaped cross-section of the inner layer. By extending part of the inner layer outwards, as illustrated in FIG. 12, an A/B ratio of 2 can be obtained while maintaining a symmetrical burning progress. The sliver formation is accordingly improved.

The grain of the present invention preferably has a structure wherein the exposed surface area of the outer layer is larger than the exposed surface area of the inner layer. Since the inner layer comprises the composition having a higher linear burn rate, the temperature of the combustion gases obtained by burning the inner layer is higher than the temperature of the combustion gases obtained by burning the outer layer. By providing a larger exposed surface area of the outer layer than that of the inner layer, undesirable barrel erosion can particularly be limited because the burning temperature at start of the ignition is lower than the final burning temperature.

Figure 13:
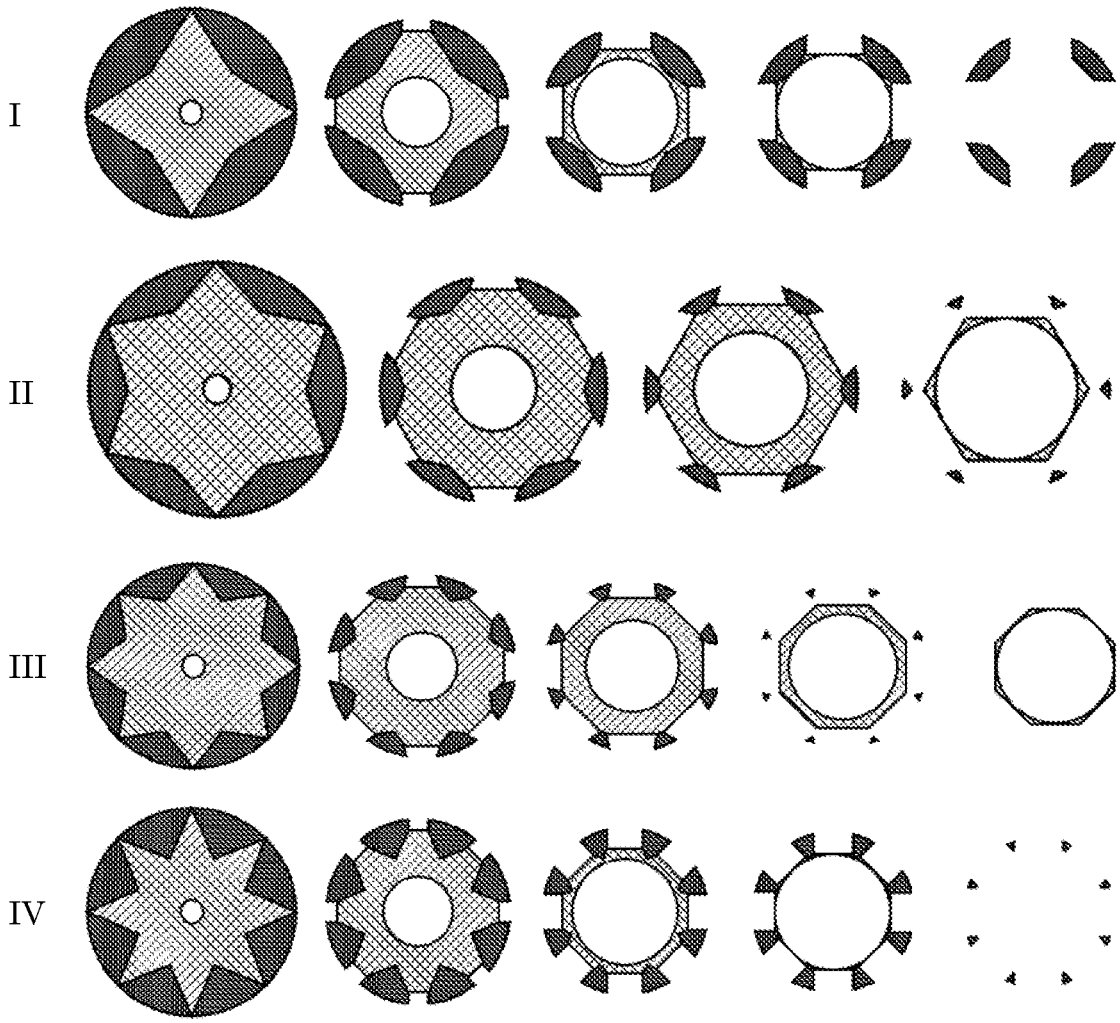
FIGS. 13, 14 and 15 illustrate cross-sections of additional cylindrically-shaped grains having a concentric perforation in accordance with the present invention.

FIG. 13 illustrates cross-sections of additional cylindrically-shaped grains having a concentric perforation. The development of the surface area and the burning profiles after ignition are included in FIGS. 4 and 5 respectively.

A further aspect of the present invention is a method for the production of the propellant grain in accordance with the present invention. Said method comprises shaping the fast burning propellant composition and the slow burning propellant composition to form the outer layer of the slow burning propellant composition and an inner layer of the fast burning propellant composition onto said inner layer.

Shaping of the compositions to form the layers may comprise different techniques. In a particular embodiment, the shaping comprises extruding the fast burning propellant composition through a die to form the inner layer and extruding the slow burning propellant composition through the same or a different die to form the outer layer adjacent to said inner layer.

Several extrusion method may be suitable for the present invention. For instance, the extrusion of the fast and slow burning propellant can be carried out by using one or more screw extruders, one or more ram presses, or a combination of one or more screw extruders and one ore more ram presses, or a single ram press exerting a force simultaneously on volumes containing fast and slow burning propellant. For example, in the case of a bi-layered propellant charge, the extrusion of the fast and slow burning propellant can be accomplished using a combination of two screw extruders, or a combination of two ram presses, or a combination of one screw extruder and one ram press, or a single ram press.

WO2015/021545, which is incorporated herein by reference in its entirety, discloses a method of co-extruding propellant composition to obtain a co-layered propellant. By adjusting the shapes of the dies in the device of WO2015/021545, e.g. to the shape of the cross-section of the inner layer, an appropriate device can be provided that is suitable for the present invention.

A preferred embodiment of the method comprises a first step of extruding the fast burning propellant composition through the die to form the inner layer, followed by a second step of passing the inner layer through the same or a different die during which the slow burning propellant composition is extruded to form the outer layer onto the inner layer. This stepwise extruding can also be referred to as co-layering, coating of the inner layer or sheathing.

An advantage of the stepwise extrusion is that the method can be more reliable since co-extrusion requires greater accuracy and precision of controlling the volume flows of the fast burning and slow burning propellant compositions than the stepwise extrusion.

Figure 14:
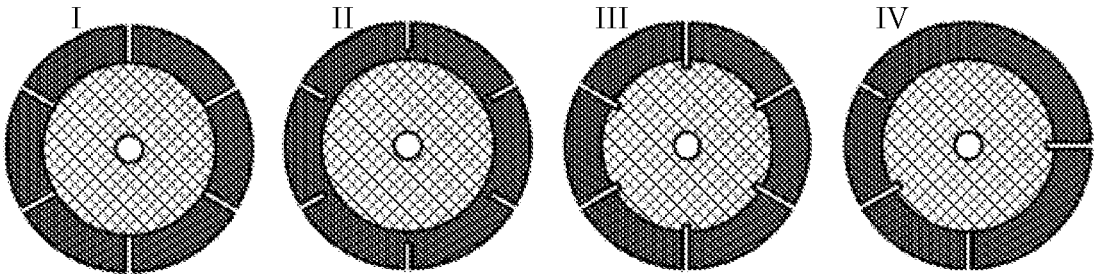
Figure 15:
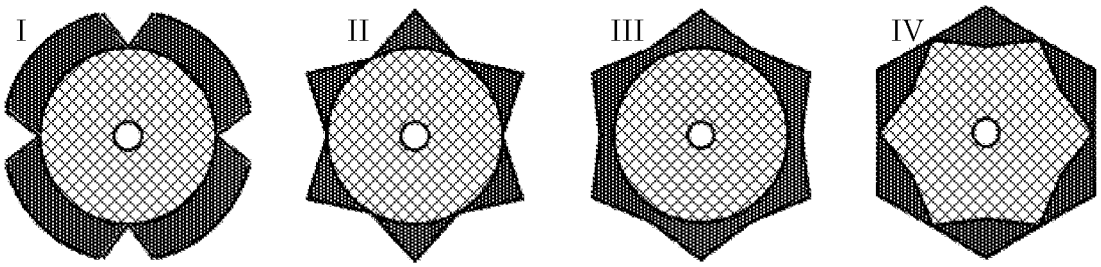

The method of the present invention may further comprise a step of deforming, cutting, milling, drilling, shaving, extruding, additive manufacturing or a combination thereof, in particular of the outer layer. For instance, a particularly suitable and facile method for the production of the propellant grain of the present invention is to provide a co-layered propellant grain as e.g. produced and described in WO2015/021545, and to subsequently cut the co-layered propellant to provide slits in the outer layer. This can result in propellant charges having a cross-sectional shape as illustrated in FIG. 14, wherein the slits in the outer layer may go up to, but not into the inner layer (FIG. 14-I), may go into only a part of the outer layer (FIG. 14-II) or may go through the outer layer and partially into the inner layer (FIG. 14-III), or any combination thereof (see e.g. FIG. 14-IV). It may also be possible to remove larger parts from the outer layer or to deform the outer layer to provide propellant grains having a cross-sectional shape as illustrated in FIGS. 15-I to 15-IV.

Figure 16:
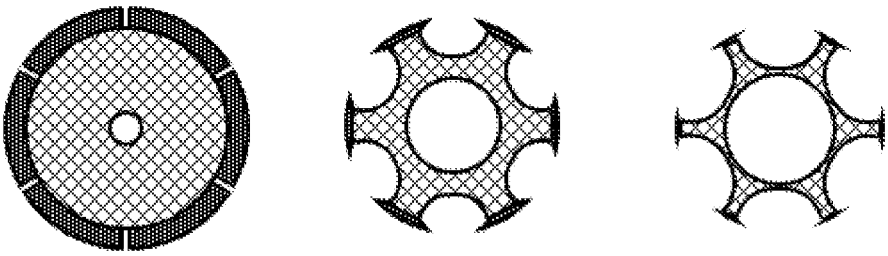
FIG. 16 illustrates the change of the cross-sectional shape of the grain having slits in the outer layer, after ignition, in accordance with the present invention.

A co-layered propellant grain having one or more slits in the outer layer typically has a strong progressive burning profile as can be deduced from FIG. 16, wherein the changing of the shape of the propellant grain after ignition is illustrated.

In another embodiment, the shaping may comprise additive manufacturing, which is also generally known as 3D-printing. The propellant grain of the invention can be shaped entirely with additive manufacturing or with a combination of extrusion and additive manufacturing. For instance, the shaping may comprise the extrusion of the inner layer in a first step, followed by a second step of the additive manufacturing of the outer layer. Alternatively, the shaping may comprise the additive manufacturing of inner layer in a first step, followed by a second step of the extrusion of the outer layer onto the inner layer.

In yet another shaping method, the inner layer is further shaped by a step of adding at least part of the outer layer onto the inner layer or by pelletizing, granulation or spray coating.

A further aspect of the present invention is a propellant charge comprising one or more of the grains according to the invention.

Yet another aspect of the present invention is ammunition, in particular ammunition for middle (i.e. 20-75 mm) and large (i.e. >75 mm) caliber guns, comprising the charge and/or grains according to the invention.

For the purpose of clarity and a concise description features are described herein as part of the same or separate embodiments, however, it will be appreciated that the scope of the invention may include embodiments having combinations of all or some of the features described.

The invention claimed is:

1. A propellant grain having an exposed outer surface, wherein said propellant grain comprises an outer layer comprising a slow burning propellant composition located on essentially the entire outer surface of the grain, and an inner layer comprising a fast burning propellant composition having a higher linear burn rate than said slow burning propellant composition, wherein said propellant grain has a structure such that after ignition, the inner layer becomes increasingly exposed at the outer surface, wherein the grain further comprises an exposed inner surface having an area that increases after ignition, wherein said propellant grain has a longitudinally extending shape and one or more perforations passing through the grain in the length direction that provide said inner surface of the grain, and wherein said inner layer is located on at least part of the inner surface.

2. The propellant grain according to claim 1, having an L/D ratio of more than 2, wherein the L/D ratio is defined as the ratio of the maximum dimension of the grain in the length direction divided by the maximal dimension of the grain perpendicular to the length direction of the grain.

3. The propellant grain according to claim 1, having a cylindrical or prism shape.

4. The propellant grain according to claim 1, wherein said inner layer has a cross-sectional shape that has one or more vertices directed towards the outer surface of the grain.

5. The propellant grain according to claim 1, wherein said inner layer has a cross-sectional shape that is rotational symmetric in an order equal to the amount of vertices of the cross-sectional shape.

6. The propellant grain according to claim 1, said propellant grain having a prism or cylindrical shape and a concentric perforation passing through the grain in the length direction that provides the inner surface, wherein said inner layer has a symmetrical cross-sectional shape that comprises one or more vertices directed toward the outer surface, and wherein the grain has an A/B ratio of about equal to the ratio of the linear burn rate of the fast-burning propellant composition to the linear burn rate of the slow burning propellant composition, wherein A is defined as the part of a geometrical line that passes the inner layer and B is defined as the part of said geometrical line that passes the outer layer, wherein the geometrical line is a line extending from the center of the grain to the outer surface while being orthogonal on the contact surface, which is defined as the surface at which the outer and the inner layers meet.

7. The propellant grain according to claim 1, having a structure such that after ignition, slivers are only produced after a conversion of 80% or more.

8. The propellant grain according to claim 1, having a structure such, that after ignition, slivers are produced that comprise both the slow burning composition and the fast burning composition during the entire burning process.

9. The propellant grain according to claim 1, having a progressive burning profile.

10. The propellant grain according to claim 1, having a structure such that before ignition, the exposed surface area of the outer layer is larger than the exposed surface area of the inner layer such that the temperature of the combustion gases at start of the ignition is lower than the temperature of the final combustion gases.

11. A propellant charge comprising one or more of the grains according to claim 1.

12. A method for the production of the propellant grain according to claim 1, comprising shaping the fast burning propellant composition and the slow burning propellant composition to form the outer layer of the slow burning propellant composition and an inner layer of the fast burning propellant composition onto said inner layer.

13. The method according to claim 12, wherein the shaping of the compositions comprises extruding the fast burning propellant composition through a die to form the inner layer and extruding the slow burning propellant composition through the same or a different die to form the outer layer onto said inner layer.

14. The method according to claim 13, comprising a first step of extruding the fast burning propellant composition through the die to form the inner layer, followed by a second step of passing the inner layer through a different die during which the slow burning propellant composition is extruded to form the outer layer onto the inner layer.

15. The method according to claim 12, wherein shaping of one or both of the compositions comprises additive manufacturing.

16. The method according to claim 12, further comprising, following the shaping, a step of deforming, cutting, milling, drilling, shaving, extruding, additive manufacturing or a combination thereof, of the outer layer.

17. The propellant grain according to claim 1, wherein said inner layer is located on essentially the entire inner surface.

18. The propellant grain according to claim 1, having an L/D ratio of more than 10 wherein the L/D ratio is defined as the ratio of the maximum dimension of the grain in the length direction divided by the maximal dimension of the grain perpendicular to the length direction of the grain.

19. The propellant grain according to claim 1, wherein said inner layer has a cross-sectional shape that has one or more vertices essentially located at the outer surface of the grain.

20. The propellant grain according to claim 1, wherein said inner layer has a cross-sectional shape of a regular polygon.

21. The propellant grain according to claim 1, having a structure such that after ignition, slivers are only produced after a conversion of 90% or more.

* * * * *